United States Patent [19]

Poran et al.

[11] Patent Number: 4,590,984

[45] Date of Patent: May 27, 1986

[54] DUMMY BAR DISCONNECTING ARRANGEMENT

[75] Inventors: Michael Poran, Westwood, N.J.; Carl Langner, Monsey, N.Y.; Stephen Karolyi, Clifton, N.J.

[73] Assignee: SMS Concast Inc., Montvale, N.J.

[21] Appl. No.: 577,111

[22] Filed: Feb. 6, 1984

Related U.S. Application Data

[63] Continuation of Ser. No. 325,253, Nov. 27, 1981, abandoned.

[51] Int. Cl.[4] ..... B22D 11/08

[52] U.S. Cl. ..... 164/426; 164/446

[58] Field of Search ..... 164/425, 426, 445, 446, 164/483

[56] References Cited

U.S. PATENT DOCUMENTS 4,290,479 9/1981 Colombo ..... 164/448

4,478,271 10/1984 Navarro et al. ..... 164/426

FOREIGN PATENT DOCUMENTS 0035988 9/1981 European Pat. Off. ..... 164/446

*Primary Examiner*—Nicholas P. Godici

*Assistant Examiner*—J. Reed Batten, Jr.

*Attorney, Agent, or Firm*—Tobias Lewenstein; Peter K. Kontler

[57] ABSTRACT

A continuous casting installation has a dummy bar which is designed such that its connection with a strand can be broken by moving the dummy bar and the strand relative to one another in a direction transverse to the longitudinal axis of the strand. A straightening roll for the strand is movable in this direction between a raised position and a lowered position. A support roll is mounted in the region of the straightening roll and is pivotable between an elevated position and a depressed position clear of the casting path. In operation, the connection between the dummy bar and the strand is positioned between the straightening roll and the support roll. The straightening roll is in its raised position and is located above the strand while the support roll is in its elevated position and supports the dummy bar. The straightening roll is now lowered to straighten the strand thereby simultaneously breaking the connection between the dummy bar and the strand. The straightened strand continues travelling along the casting path and the leading end of the strand moves into the support roll and pivots the latter to its depressed position. The proximity of the straightening roll and the support roll results in the exertion of only a small moment on the dummy bar during disconnection from the strand. The ability of the support roll to be pivoted to a position clear of the casting path virtually eliminates any danger of this roll stopping the strand and interrupting the casting operation.

20 Claims, 1 Drawing Figure

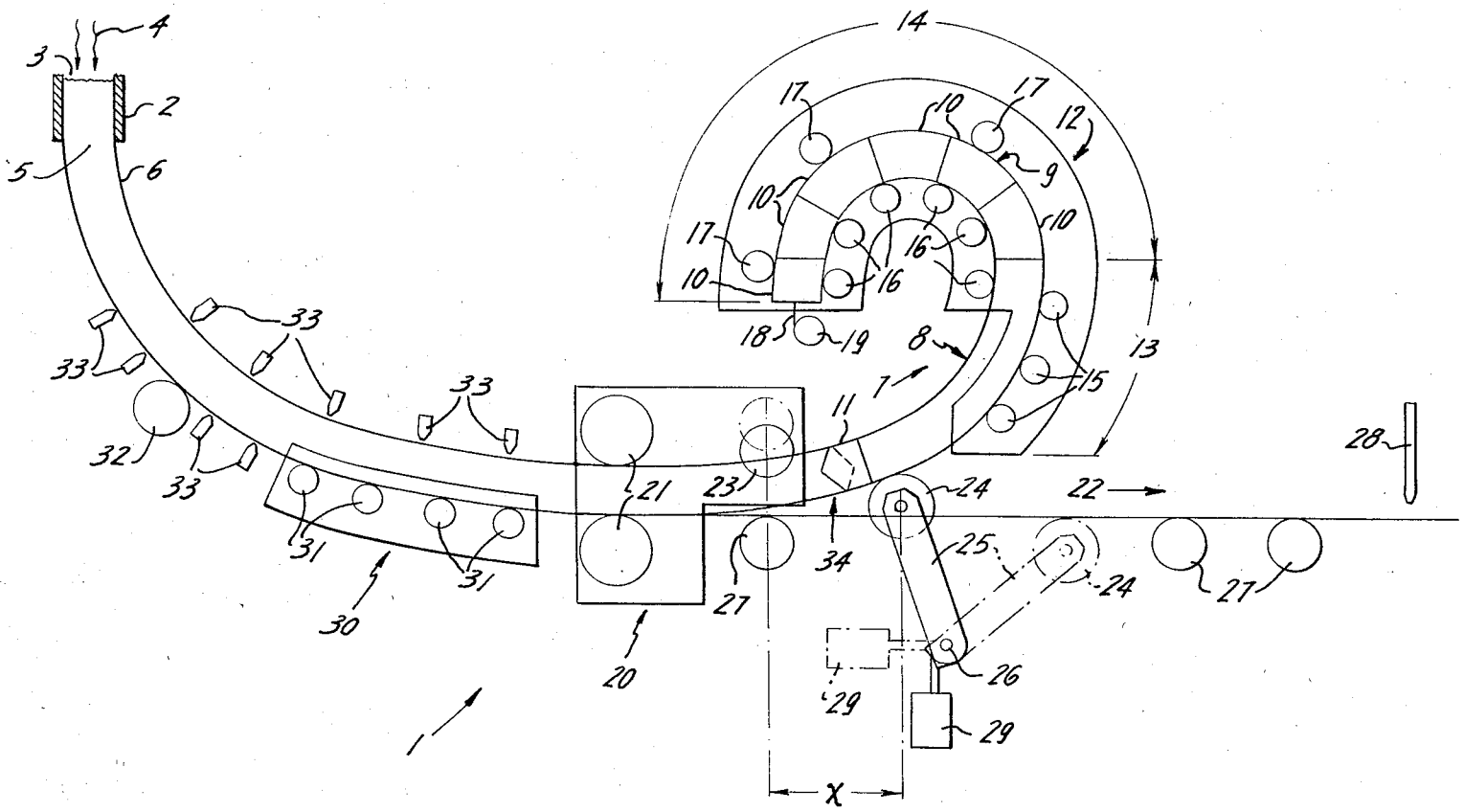
1
2
3
4
5
6
7
8
9
10
11
12
13
14
15
16
17
18
19
20
21
22
23
24
25
26
27
28
29
30
31
32
33
34
X

DUMMY BAR DISCONNECTING ARRANGEMENT

This application is a continuation, of application Ser. No. 325,253, filed Nov. 27, 1981 and now abandoned.

FIELD OF THE INVENTION

The invention relates generally to the continuous casting of metals, e.g. steel.

More particularly, the invention relates to an arrangement for separating a continuously cast strand from the starter or dummy bar.

BACKGROUND OF THE INVENTION

Many of the newer, curved-mold continuous casting machines employ a rigid or semi-rigid dummy bar. A rigid dummy bar has a radius of curvature equal to the casting radius and is essentially rigid along its entire length. This length is somewhat greater than the distance between the mold and the withdrawal unit which is used to feed the dummy bar into the mold and withdraw it therefrom. Semi-rigid dummy bars are similar but have a flexible portion remote from the mold. The flexible portion makes it possible to store a semi-rigid dummy bar more compactly than a rigid dummy bar.

Dummy bars of the above types are generally stored in racks which are coplanar with and located above the casting path. It is desirable for the storage rack to be somewhat removed from the effect of the heat which radiates from the continuously cast strand. For this reason, the end of the storage rack through which the dummy bar enters and leaves the same is located relatively far from the withdrawal unit.

The withdrawal unit generally includes a movable straightening roll for straightening the strand which tends to maintain the curvature of the mold. This roll is normally located above the casting path and remains in this position until the junction between the strand and the dummy bar has passed by it. The straightening roll is then lowered onto the leading end of the strand to straighten the latter. This action simultaneously causes the strand to be disconnected from the dummy bar.

At the time of disconnection, a major portion of the dummy bar is in the storage rack. The remainder of the dummy bar projects from the storage rack to the junction between the strand and the dummy bar. The projecting portion of the dummy bar transmits the reaction to the force required to disconnect the strand from the dummy bar to the end of the storage rack via which the dummy bar enters and leaves the same. Since this end is located relatively far from the withdrawal unit, the moment generated by the disconnecting force is large, especially when the strand and the dummy bar stick to one another. This moment can result in deformation of the dummy bar thereby causing the latter to be out of alignment with the mold so that the dummy bar can no longer enter the mold. This problem is aggravated in continuous casting machines for small strands such as billets where there is minimal or no guiding structure between the mold and the withdrawal unit.

In a known continuous casting machine, the above problem is alleviated by arranging a support bracket immediately downstream of the straightening roll. The support bracket is rigidly mounted on the base of the withdrawal unit and supports the dummy bar during disconnection of the same from the strand. At the time of disconnection, the junction between the dummy bar and the strand is located between the straightening roll and the support bracket. Since the distance between the straightening roll and the support bracket is short, the moment on the dummy bar is small.

The support bracket straddles the casting path and the strand passes through the support bracket after being disconnected from the dummy bar. However, if the strand should distort for some reason, e.g. due to non-uniform cooling, there is a danger that the leading end of the strand will run into the support bracket. For example, if the strand distorts in such a manner that the leading end of the strand is displaced towards one side of the casting path, the leading end of the strand may come into engagement with a supporting leg of the support bracket. Inasmuch as the latter is rigidly mounted, a number of problems, e.g. damage to the support bracket or a breakout, leading to shutdown of the continuous casting machine could occur.

OBJECT OF THE INVENTION

An object of the invention is to minimize distortion of a dummy bar during disconnection thereof from a strand while reducing the risk of shutdown of the continuous casting machine.

SUMMARY OF THE INVENTION

The preceding object and others will become apparent as the description proceeds.

One aspect of the invention relates to a continuous casting installation which comprises a mold having an inlet end for molten metal and an outlet end for a continuously cast strand. A dummy bar is provided for closing the outlet end of the mold prior to admitting molten metal into the latter and for forming a connection with the strand. Withdrawal means withdraws the dummy bar and the strand from the mold and conveys the strand along a predetermined path. Disconnecting means downstream of the withdrawal means disconnects the strand from the dummy bar. The disconnecting means includes first and second members movable between respective first and second rest positions clear of the strand and respective neighboring first and second operative positions in which the members cooperate to disconnect the strand from the dummy bar.

The connection or junction between the strand and the dummy bar is positioned intermediate the first and second members during disconnection of the strand from the dummy bar. Since the first and second members occupy neighboring positions at the time that the strand and the dummy bar are disconnected, the moment on the dummy bar is relatively small. Accordingly, deformation of the dummy bar during disconnection thereof from the strand may be almost entirely avoided. On the other hand, since the member which is located downstream of the dummy bar-strand connection at the time the connection is broken is movable to a position clear of the strand, that is, to a position in which the member does not block the strand, the risk of stoppage of the strand, and hence of the casting operation, by this member is virtually eliminated.

Other features of the invention will be apparent from the following description when read in conjunction with the accompanying drawing.

BRIEF DESCRIPTION OF THE DRAWING

The single FIGURE is a schematic, sectional elevational side view of a continuous casting installation according to the invention.

DESCRIPTION OF THE PREFERRED EMBODIMENTS

In the FIGURE, a continuous casting installation is identified generally by the reference numeral 1. The continuous casting installation 1 is of the type used for the continuous casting of metals, especially steel.

The continuous casting installation 1 includes a mold 2 which is here illustrated as being of the curved type. The mold 2 has an inlet end 3 via which a stream 4 of molten metal, e.g. steel, is fed into the mold 2. The mold 2 further has an outlet end 5 via which a strand 6 issues from the mold 2. The walls of the mold 2 are cooled in a known manner and the molten metal in contact with the walls of the mold 2 solidifies. In the case of steel, the thermal conductivity of the molten metal in relation to the dimensions of the mold 2 is usually such that only the molten metal adjacent the walls of the mold 2 solidifies internally of the latter. Accordingly, the strand 6 then consists of a solidified outer shell and a molten core upon leaving the mold 2. The mold 2 is mounted for oscillation along its longitudinal axis as is conventional in order to prevent sticking of the strand 6 to the walls of the mold 2.

A dummy bar 7 is provided for initiating the withdarwal of the strand 6 from the mold 2. The dummy bar 7 is of the semi-rigid type, that is, the dummy bar 7 is composed of a rigid section 8 which extends for a substantial fraction of the length of the dummy bar 7 and a flexible section 9 constituted by a number of pivotally connected links 10. The rigid section 8 has a radius equal to the casting radius which is the radius of curvature of the mold 2 and the strand 6. The rigid section 8 includes a dummy bar head 11 which forms a connection with the strand 6 and is here assumed to be of the permanent, quick-disconnect type. In other words, the dummy bar head 11 has a cavity which receives a projection on the leading end of the strand 6 and may be readily disconnected from the strand 6 without damage by moving the latter and the dummy bar head 11 relative to one another in a predetermined direction. The dummy bar head 11 may be subsequently reused.

The dummy bar 7 need not be of the semi-rigid type but could, for example, be rigid in its entirety. Similarly, it is not necessary for the dummy bar head 11 to be a permanent, quick-disconnect dummy bar head. For instance, the dummy bar head 11 could be in the form of a bolt which is removably connected to the dummy bar 7 and becomes embedded in the strand 6 during casting. In such an event, the dummy bar 7 and the strand 6 are disconnected by shearing the bolt.

When the dummy bar 7 is not in use, the dummy bar 7 is accommodated in a storage rack 12. The storage rack 12 includes a storage section 13 which receives the rigid section 8 of the dummy bar 7 and a storage section 14 which receives the flexible section 9 thereof.

The storage section 13 has rolls 15 on which the rigid section 8 rests. The rolls 15 are arranged on the arc of the casting radius and thus conform to the curvature of the rigid section 8. The arrangement of the rolls 15 on the arc of the casting radius, which is the same arc as that on which the mold 2 is situated, also facilitates movement of the dummy bar 7 towards and away from the mold 2. Thus, the rolls 15 guide the rigid section 8 along the proper path as the dummy bar 7 enters and leaves the storage rack 12.

The storage section 14 has rolls 16 on which the flexible section 9 of the dummy bar 7 rests. The flexible section 9 is capable of bending to a radius substantially smaller than the casting radius. This enables the semi-rigid dummy bar 7 to be stored more compactly than a dummy bar which is substantially rigid along its entire length. Accordingly, the rolls 16 are arranged on an arc having a radius substantially smaller than the casting radius.

In addition to the support rolls 15 and 16, the storage rack 12 is provided with guide rolls 17 which function primarily as an aid in guiding the dummy bar 7 into the storage rack 12.

A cable 18 is secured to the end of the dummy bar 7 remote from the dummy bar head 11. The cable 18 is connected to a winch 19 which serves to draw the dummy bar 7 into the storage rack 12 and to control the discharge of the dummy bar 7 therefrom.

A withdrawal and straightening unit 20 is located between the mold 2 and the storage rack 12. The withdrawal and straightening unit 20 is situated in the region of the tangent point, that is, the point at which the strand 6 becomes horizontal. The withdrawal and straightening unit 20 includes a pair of driven withdrawal rolls 21 which serve to feed the dummy bar 7 towards the mold 2 and to withdraw the dummy bar 7 therefrom. The withdrawal rolls 21 further function to convey the strand 6 along the casting path identified by the arrow 22 once the strand 6 has been disconnected from the dummy bar 7. The upper withdrawal roll 21 may be moved towards and away from the lower withdrawal roll 21 in order to adjust the width of the gap between the withdrawal rolls 21 to the thicknesses of the strand 6 and the dummy bar 7.

The withdrawal and straightening unit 20 further comprises a straightening roll 23 which participates in disconnecting the strand 6 from the dummy bar 7 and also serves to straighten the strand 6. The straightening roll 23 is movable in a direction transverse to the longitudinal axis of the strand 6 between a rest position indicated in dashed lines and an operative position indicated in full lines. In the operative position, the straightening roll 23 bears against the strand 6 and assists in guiding the latter along the casting path 22. The rest position of the straightening roll 23 is removed from the casting path 22 in order to permit the dummy bar 7 to travel from the storage rack 12 to the mold 2 and back.

Although the straightening roll 23 is here illustrated as constituting part of the withdrawal and straightening unit 20, it is possible to provide a withdrawal unit and a separate straightening unit.

A roll 24 is located on the side of the strand 6 and dummy bar 7 remote from the straightening roll 23. The roll 24 is rotatably secured to one end of a bar 25 which is pivotally mounted on a shaft 26 at its other end. The roll 24 is pivotable between a rest position indicated in broken lines and an operative position indicated in full lines. In its rest position, the roll 24 is clear of the strand 6 when this moves along the casting path 22, that is, the roll 24 does not project into the casting path 22 and block the strand 6. However, the roll 24 supports the strand 6 as the latter travels along the casting path 22 when the roll 24 is in its rest position. Thus, in the rest position, the roll 24 is aligned with the rolls 27 of a torch approach table via which the strand 6 is conveyed to a torch 28 which cuts the strand 6 into sections of predetermined length in a conventional manner.

In its operative position, the roll 24 is situated in the region of the straightening roll 23. In other words, the distance "x" between the straightening roll 23 and the roll 24 when the latter is in its operative position is small as compared to the distance between the straightening roll 23 and the nearest of the support rolls 15 of the storage rack 12. When the straightening roll 23 moves from its rest position to its operative position, the roll 24 is in its operative position and cooperates with the straightening roll 23 to disconnect the strand 6 from the dummy bar 7. The roll 24 is normally urged into its operative position by a counterweight 29 mounted on the end of the bar 25 remote from the roll 24.

A chute 30 having rolls 31 is situated in the vicinity of the withdrawal and straightening unit 20 on the side of the latter facing the mold 2. The rolls 31 are aligned with the casting path 22 and arranged on an arc corresponding to the casting radius. The chute 30 is designed to support the flexible section 9 of the dummy bar 7 when the dummy bar 7 is positioned so as to close the outlet end 5 of the mold 2.

A guide roll 32 is located between the chute 30 and the mold 2 to guide the dummy bar head 11 into the outlet end 5 of the mold 2.

Spray nozzles 33 are arranged between the withdrawal and straightening unit 20 and the mold 2 to cool the strand 6 after this exits from the mold 2.

In operation, the dummy bar 7 is accommodated in the storage rack 12 prior to the beginning of a casting operation. The dummy bar 7 is fed to the mold 2 in order to close the outlet end 5 thereof before the casting operation is initiated. This is achieved by unlocking the winch 19 and permitting the dummy bar 7 to descend from the storage rack 12 by gravity but under the control of the winch 19. The guide rolls 15 of the storage section 13 guide the dummy bar 7 into the withdrawal and straightening unit 20 along an arcuate path having a radius of curvature equal to the casting radius. The straightening roll 23 is in its rest position so that it does not interfere with the movement of the dummy bar 7 into the withdrawal and straightening unit 20. On the other hand, the roll 24 is in its operative position because of the counterweight 29 and helps to support and guide the dummy bar 7 as the latter enters the withdrawal and straightening unit 20.

The upper withdrawal roll 21 is displaced from the lower withdrawal roll 21 by a distance which is sufficient to insure ready entry of the dummy bar 7 into the gap between the withdrawal rolls 21. In other words, the upper withdrawal roll 21 is raised to such an extent that the spacing between the withdrawal rolls 21 exceeds the thickness of the dummy bar 7. Once the dummy bar 7 has entered the bite of the withdrawal rolls 21, the upper withdrawal roll 21 is lowered so that the dummy bar 7 is firmly gripped by the withdrawal rolls 21. The latter are now started and continue to feed the dummy bar 7 towards the mold 2.

As the dummy bar 7 leaves the storage rack 12, the flexible section 9 of the dummy bar 7 assumes the casting radius. In order to stabilize the flexible section 9, the latter is provided with arresting devices which prevent the flexible section 9 from bending beyond the casting radius.

The length of the dummy bar 7 exceeds the distance between the outlet end 5 of the mold 2 and the withdrawal rolls 21. This permits the end of the dummy bar 7 remote from the dummy bar head 11 to be engaged by the withdrawal rolls 21 when the dummy bar head 11 is received in the mold 2.

The guide roll 32 guides the dummy bar head 11 into the outlet end 5 of the mold 2. The dimensions of the dummy bar head 11 are somewhat smaller than the internal dimensions of the mold 2 so that the dummy bar head 11 fits in the mold 2 with clearance. Once the dummy bar head 11 has reached the proper position in the mold 2, the withdrawal rolls 21 are stopped. The dummy bar head 11 is sealed in a conventional manner to prevent molten metal from entering the gap between the dummy bar head 11 and the mold 2. The flexible section 9 of the dummy bar 7 rests on the chute 30 and is engaged by the withdrawal rolls 21.

The stream 4 of molten metal is admitted into the inlet end 3 of the mold 2. The first quantities of molten metal introduced into the mold 2 solidify in contact with the dummy bar head 11 and form a connection 34 therewith.

As soon as the molten metal in the mold 2 reaches a predetermined level, the withdrawal rolls 21 are started to withdraw the dummy bar 7 from the mold 2. The dummy bar 7 draws along the strand 6 behind it. The withdrawal rate is here assumed to be such relative to the cooling rate in the mold 2 that only the molten metal adjacent the walls of the mold 2 solidifies inside the latter. The strand 6 thus consists of a solidified outer shell and a molten core upon leaving the mold 2. As the strand 6 travels from the mold 2 to the withdrawal and straightening unit 20, water is sprayed onto the strand 6 by the nozzles 33 at a rate sufficient to completely solidify the strand 6 before this reaches the withdrawal and straightening unit 20.

The dummy bar 7 reenters the storage rack 12 as it is withdrawn from the mold 2. The guidance required for reentry of the dummy bar 7 into the storage rack 12 is provided by the cable 18 secured to the end of the dummy bar 7 remote from the dummy bar head 11. The winch 19 which engages the cable 18 provides the motive power required to draw the dummy bar 7 into the storage rack 12 when the dummy bar 7 is no longer driven by the withdrawal rolls 21. The speed of the winch 19 is synchronized with that of the withdrawal rolls 21 while the dummy bar 7 is connected with the strand 6.

The strand 6 has a curvature equal to the casting radius as a result of being cast in the curved mold 2. Since the strand 6 tends to maintain this curvature and is connected with the dummy bar 7, the strand 6 follows the path of the dummy bar 7 and begins to move towards the storage rack 12 after passing between the withdrawal rolls 21.

When the connection 34 between the dummy bar 7 and the strand 6 is located between the straightening roll 23 and the roll 24, the withdrawal rolls 21 and the winch 19 are stopped. At this time, the roll 24 is in its operative position and supports the dummy bar 7 in the region of the dummy bar head 11. On the other hand, the straightening roll 23, which is still in its rest position, is located above the strand 6 in the region of the leading end thereof. The straightening roll 23 is now lowered to its operative position thereby straightening the strand 6. The roll 24 prevents the dummy bar 7 from moving downwards with the strand 6. The connection 34 between the dummy bar 7 and the strand 6 is such that the downward movement of the straightening roll 23 simultaneously causes the strand 6 to disconnect from the dummy bar 7.

Once the connection 34 between the strand 6 and the dummy bar 7 is broken, the winch 19 is restarted to finish drawing the dummy bar 7 into the storage rack 12. The withdrawal rolls 21 are also restarted and continue to convey the strand 6 along the casting path 22. Since the straightening roll 23 remains in its operative position, the strand 6 moves in a straight line after leaving the withdrawal and straightening unit 20. This causes the leading end of the strand 6 to run into the roll 24. Inasmuch as the withdrawal rolls 21 have sufficient power to raise the counterweight 29, the strand 6 pivots the roll 24 to its rest position as it continues to travel along the casting path 22. The weight of the strand 6 holds the roll 24 in its rest position for the remainder of the casting operation during which the roll 24 supports the strand 6.

Once the trailing end of the strand 6 has passed by the roll 24, the counterweight 29 causes the roll 24 to pivot back to its operative position. The straightening roll 23 is raised to its rest position and the continuous casting installation is readied for the next casting operation.

As mentioned previously, the distance "x" between the straightening roll 23 and the roll 24 is small as compared to the distance between the straightening roll 23 and the nearest of the support rolls 15 of the storage rack 12. Thus, the moment acting on the dummy bar 7 during disconnection from the strand 6 is substantially reduced as compared to an arrangement without the roll 24. Furthermore, since the roll 24 is mounted so as to be movable from its operative position to its rest position by the strand 6, the danger of the roll 24 stopping the strand 6 and thereby causing interruption of a casting operation is virtually non-existent.

Although preferred embodiments of the invention have been described above, it will be understood that modifications are possible within the scope of the invention.

We claim:

1. A continuous casting installation comprising:

(a) a mold having an inlet end for molten metal and an outlet end for a continuously cast strand;

(b) a dummy bar for closing said outlet end prior to admitting molten metal into said mold and for forming a connection with the strand;

(c) withdrawal means for withdrawing said dummy bar and the strand from said mold and conveying the strand along a predetermined path;

(d) disconnecting means downstream of said withdrawal means for separating the strand and said dummy bar, said disconnecting means including first and second members movable between respective first and second rest positions out, and on opposite sides of, said path, and respective first and second operative positions in which at least one of said members is at least partially in said path and said members cooperate to separate the strand from said dummy bar; and (e) a counterweight biasing said second member to said second operative position.

2. The installation of claim 1, wherein said first member is formed as a unit with said withdrawal means.

3. The installation of claim 1, wherein said first member is mounted for movement in a direction transverse to said path.

4. The installation of claim 1, wherein said second member is pivotally mounted.

5. The installation of claim 1, comprising means downstream of said disconnecting means defining a dummy bar storage surface, said second member being aligned with said path in said second rest position and with said storage surface in said second operative position.

6. The installation of claim 1, wherein said second member is located downstream of said first member and projects into said path in said second operative position, said second member being arranged to be moved from said second operative position to said second rest position by the strand after separation thereof from said dummy bar.

7. The installation of claim 1, wherein said path is arcuate upstream of said disconnecting means and at least a substantial portion of said dummy bar is arcuate and substantially rigid; and further comprising means downstream of said disconnecting means defining an arcuate dummy bar storage surface which is aligned with said path and is arranged to receive said arcuate portion of said dummy bar.

8. The installation of claim 1, wherein each of said members comprises a roll.

9. The installation of claim 1, wherein each of said members is at least partially in said path in the respective operative position.

10. The installation of claim 1, wherein each of said members is movable between the respective rest and operative positions independently of the other member.

11. The installation of claim 1, wherein said first member is arranged to deflect and said second member is arranged to support the strand or said dummy bar during separation of the latter from the strand.

12. The installation of claim 11, wherein said first member is arranged to deflect the strand and said second member is arranged to support said dummy bar during separation of the latter from the strand.

13. A continuous casting installation comprising:

(a) a mold having an inlet end for molten metal and an outlet end for a continuously cast strand;

(b) a dummy bar for closing said outlet end prior to admitting molten metal into said mold and for forming a connection with the strand;

(c) withdrawal means for withdrawing said dummy bar and the strand from said mold and conveying the strand along a predetermined path;

(d) disconnecting means downstream of said withdrawal means for separating the strand and said dummy bar, said disconnecting means including first and second members movable between respective first and second rest positions out, and on opposite sides of, said path, and respective first and second operative positions in which at least one of said members cooperate to separate the strand from said dummy bar; and (e) biasing means continuously urging said second member to said second operative position in all positions of said second member.

14. The installation of claim 13, wherein said first member is arranged to deflect the strand and said second member is arranged to support said dummy bar during separation of the latter from the strand.

15. The installation of claim 13, wherein said first member is formed as a unit with said withdrawal means.

16. The installation of claim 13, wherein said second member is pivotally mounted.

17. The installation of claim 13, comprising means downstream of said disconnecting means defining a dummy bar storage surface, said second member being aligned with said path in said second rest position and with said storage surface in said second operative position.

18. The installation of claim 13, wherein said second member is located downstream of said first member and projects into said path in said second operative position, said second member being arranged to be moved from said second operative position to said second rest position by the strand after separation thereof from said dummy bar.

19. The installation of claim 13, wherein said path is arcuate upstream of said disconnecting means and at least a substantial portion of said dummy bar is arcuate and substantially rigid; and further comprising means downstream of said disconnecting means defining an arcuate dummy bar storage surface which is aligned with said path and is arranged to receive said arcuate portion of said dummy bar.

20. The installation of claim 13, wherein each of said members is movable between the respective rest and operative positions independently of the other member.

* * * * *